US005839312A

United States Patent [19]

Itaya

[11] Patent Number: 5,839,312

[45] Date of Patent: Nov. 24, 1998

[54] SPRING MANUFACTURING APPARATUS

[75] Inventor: Ichiro Itaya, Tokyo, Japan

[73] Assignee: Kabushiki Kaisha Itaya Seisaku Sho, Tokyo, Japan

[21] Appl. No.: 908,150

[22] Filed: Aug. 6, 1997

[30] Foreign Application Priority Data

Aug. 23, 1996 [JP] Japan ..... 8-222813

[51] Int. Cl.[6] ..... B21F 3/04; B21F 3/02

[52] U.S. Cl. ..... 72/142; 72/135

[58] Field of Search ..... 72/135, 137, 138, 72/140, 142, 145, 307, 428, 442, 441

[56] References Cited

U.S. PATENT DOCUMENTS

| | | | |
|---|---|---|---|
| 4,825,678 | 5/1989 | Post | 72/307 |
| 4,934,165 | 6/1990 | Philpost et al. . | |
| 5,259,226 | 11/1993 | Itaya . | |
| 5,285,669 | 2/1994 | Itaya . | |
| 5,363,681 | 11/1994 | Speck et al. . | |
| 5,452,598 | 9/1995 | Cheng . | |

FOREIGN PATENT DOCUMENTS

| | | |
|---|---|---|
| 1 254 927 | 10/1995 | Italy . |
| 1 254 928 | 10/1995 | Italy . |
| 1 254 929 | 10/1995 | Italy . |
| 52-040633 | 10/1977 | Japan . |
| 54-052661 | 4/1979 | Japan . |
| 54-052662 | 4/1979 | Japan . |
| 59-144542 | 8/1984 | Japan . |
| 61-190326 | 11/1986 | Japan . |
| 62-148045 | 7/1987 | Japan . |

OTHER PUBLICATIONS

Handbuch Federn, Verlag Technik Berlin, 1988, pp. 60–61, Fig. 3.2.

"Dictionary of Metal Material Technical Term with Explanatory Diagram", by Nikkan Kogyo Shinbun Sha, Nov. 20, 1988.

*Primary Examiner*—Joseph J. Hail, III
*Assistant Examiner*—Rodney Butler
*Attorney, Agent, or Firm*—Merchant, Gould, Smith, Edell, Welter and Schmidt

[57] ABSTRACT

A wire-grip mechanism 60 for gripping a wire W, is arranged rotatable in accordance with a wire guide 70 which feeds the wire W. By rotating a guide mechanism while feed rollers and wire grip mechanism 60 are gripping the wire W, the wire W positioned between the feed rollers and grip mechanism is twisted, and the direction of the wire W fed from the wire guide 70 is changed.

8 Claims, 14 Drawing Sheets

SPRING MANUFACTURING APPARATUS

BACKGROUND OF THE INVENTION

1. Field of the Invention

The present invention relates to a spring manufacturing apparatus and, more particularly, to a spring manufacturing apparatus for manufacturing, for instance, compression coil springs, extension coil springs, torsion coil springs and the like.

2. Description of Related Art

As a conventional spring manufacturing apparatus, Japanese Patent Application No. 6-149143, which has been filed by the applicant of the present invention, discloses a spring manufacturing apparatus which can be commonly used to form various shapes of spring. This spring manufacturing apparatus comprises a spring-forming space where tools for bending, coiling or cutting a wire to form a desired spring shape are slidably provided in a radial pattern, and also comprises a rotatable wire guide which feeds a wire to the spring-forming space, so that the apparatus can be used to form various shapes of springs by simply changing the position of the spring-forming space.

However, when forming a spring by the above described spring manufacturing apparatus, the direction of the wire fed from the wire guide may sometimes deviate in forming a spring because of a spring shape. Therefore, it is necessary to include a correction tool (e.g. an air cylinder) on the periphery of the guide for correcting the wire direction of the guide, and form the spring while the correction tool corrects the deviation of the wire direction in each forming operation.

As another technique of correcting such deviation of the wire direction, Japanese Patent Publication No. 62-148045 discloses another spring manufacturing apparatus. According to the spring manufacturing apparatus, a chuck nail which grips a wire is provided between a spring-forming position and a feed roller. The chuck nail, while gripping the wire, enables the wire to rotate upon an axis along the wire direction. Accordingly, the spring manufacturing apparatus can form a spring by forcibly twisting the wire in accordance with positions of the tools. In addition, the spring manufacturing apparatus can be commonly utilized for forming a spring which requires bending in multiple directions, regardless of the positions of the tools, while correcting deviation of the wire direction.

Furthermore, Japanese Patent Application Laid-Open No. 6-87048 discloses a spring manufacturing apparatus capable of manufacturing a spring which requires three-dimensional bending, while correcting deviation of the wire direction. This spring manufacturing apparatus comprises a feed roller which feeds a wire to the spring-forming space. The feed roller, while gripping the wire, enables the wire to rotate upon an axis along the wire direction.

In any of the foregoing conventional technique, it is preferable to coil the wire within the range of elastic deformation of the wire and to secure a large torsion amount (angle) in order to improve flexibility in spring forming.

However, according to the technique disclosed in the Japanese Patent Publication 62-148045, since the chuck nail which grips the wire is provided between the spring-forming position and feed roller, the distance between the spring-forming position and wire coiling position is reduced, making it difficult to secure a large torsion amount. In addition, since the mechanism which enables the chuck nail to grip and rotate the wire is complicated and large, the chuck nail must be arranged in a wide space, e.g., between the spring-forming position and the feed roller. Because of this reason, there is not much flexibility left in terms of layout and down-sizing of the apparatus becomes difficult.

Furthermore, according to the technique disclosed in Japanese Patent Application Laid-Open No. 6-87048, since the feed roller which feeds the wire is rotated, precision in spring forming, such as the wire-feed amount and bending angle or the like, may be deteriorated.

SUMMARY OF THE INVENTION

The present invention has been made in consideration of the above situation, and has as its object to provide a spring manufacturing apparatus having a grip mechanism for gripping a wire, and the grip mechanism is rotatable along with a wire guide which feeds the wire. Accordingly, the conventional correction tool or rotation mechanism of the chuck nail become unnecessary so that it is possible to improve flexibility in the layout while securing a large torsion amount, and it is possible to down-size the apparatus, whereby reducing the cost.

Furthermore, another object of the present invention is to provide a spring manufacturing apparatus which can improve precision in spring forming, and reduce working time. This is realized by setting, in advance, a deviation of wire direction generated in the similar forming operation. Accordingly, it is possible to adjust wire direction of the guide at each forming process.

In order to solve the aforementioned problems and attain the foregoing objects, the spring manufacturing apparatus according to the present invention has the following construction.

More specifically, the spring manufacturing apparatus is provided for forming a spring from a wire (W) fed from an end of a wire guide (70) having an internal space, and forcibly bending or coiling the wire (W) with the use of tools (30) which are pointed against the wire (W) for bending and coiling the wire, and are arranged slidably in a radial pattern toward a spring-forming space near the end of the wire guide (70), the wire guide (70) having a wire feedout hole (73) for feeding the wire (W) to the spring-forming space. The apparatus comprises: rotating means (40), rotatably provided in the central area of a main body of the apparatus where sliding locus of the tools (30) intersects, for rotating the wire guide (70) around the wire feedout hole (73) while supporting the wire guide (70); first driving means (17, 18, 19) for transmitting rotation force to the rotating means (40); wire-feeding means (14, 15), provided in the upstream side of a wire-feeding path along a wire direction of the rotating means (40), for feeding the wire (W) to the spring-forming space through the wire feedout hole (73) by rotating the wire (W) while gripping the wire; second driving means (16) for driving the wire-feeding means (14, 15); wire-gripping means (60), provided in an internal space of the wire guide (70), for gripping the wire (W) between internal walls of the wire feedout hole (73); third driving means (90) for driving the wire-griping means (60) to grip the wire (W); and controlling means (200) for controlling the first, second and third driving means (17 to 19, 16, 90) at a predetermined timing, and rotating the rotating means (40) while the wire-feeding means (14, 15) and the wire-gripping means (60) grip the wire, so that the wire (W) positioned between the wire-feeding means (14, 15) and wire-gripping means (60) is temporarily twisted and a direction of the wire fed from the wire feedout hole (73) is changed.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follows the description for determining the scope of the invention.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENT

Preferred embodiment of the present invention will be described in detail in accordance with the accompanying drawings.

[Overall Structure of Spring Manufacturing Apparatus]

Description will be first provided on the overall structure of a spring manufacturing apparatus provided as an embodiment of the present invention.

Figure 1:
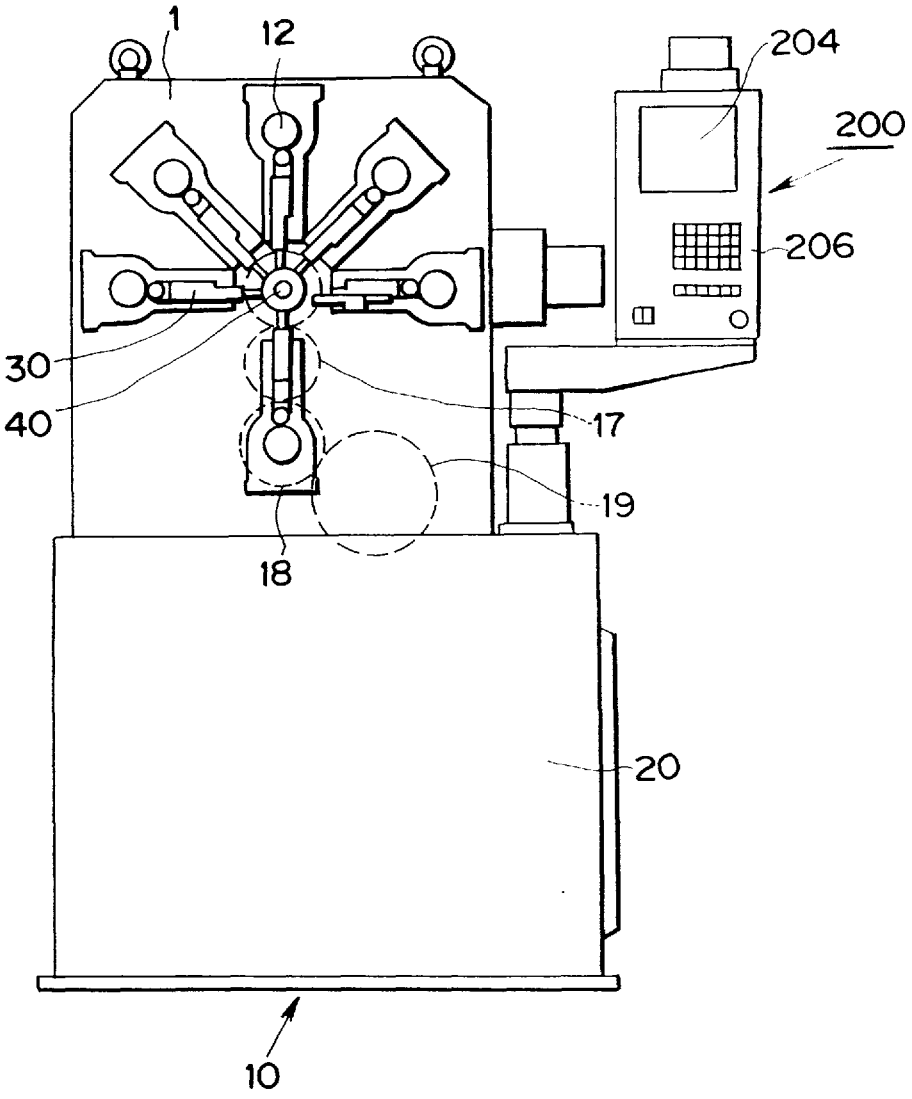
FIG. 1 is a front view showing a spring manufacturing machine according to an embodiment of the present invention.
Figure 2:
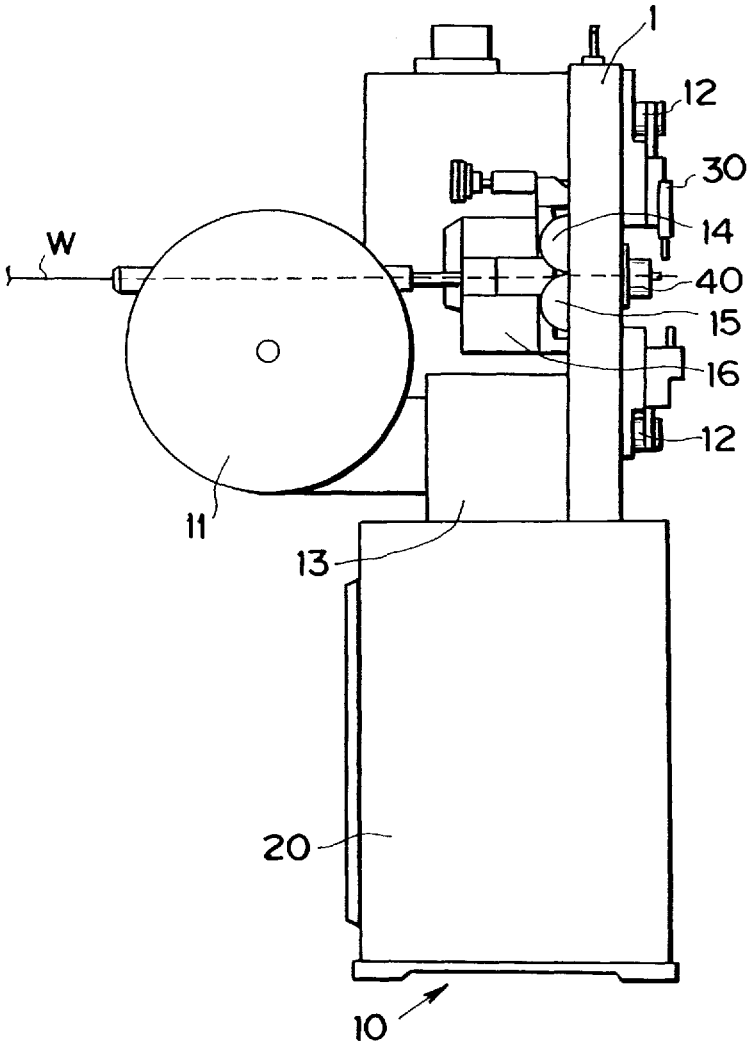
FIG. 2 is a side view of the spring manufacturing machine shown in FIG. 1.

FIG. 1 is a front view showing the spring manufacturing machine according to an embodiment of the present invention. FIG. 2 is a side view of the spring manufacturing machine shown in FIG. 1.

As shown in FIGS. 1 and 2, the spring manufacturing machine 10 comprises a box-shaped/rectangular-parallelepiped machine main body 20, a spring-forming table 1 which is placed on the upper surface of the machine main body 20, and a controller 200 which controls the entire machine.

On the spring-forming table 1, a rotary-type wire guide mechanism (hereinafter referred to as a guide mechanism) 40 and various tools 30 for forming a wire W into a spring having a desired shape are provided. The tools 30, including plural tools provided on the spring-forming table 1, are arranged in a radial pattern around a wire-feedout hole of the guide mechanism 40. The guide mechanism 40 feeds the wire W to the spring-forming space on the spring-forming table. The guide mechanism 40 is provided rotatable with the wire-feedout hole as its center, and is arranged in the central area of the spring-forming space where the sliding locus of each of the tools 30 intersects. The spring-forming space is determined by the front end area of the tools 30 where axes of the tools 30 intersect, and the front end portion and inclined surface of a wire guide 70 which is to be described later. The tools 30 include various types of tools depending on the purpose, such as a bending tool for bending a wire, a coiling tool for winding and coiling the wire, cutting tool for cutting the wire and the like. The arrangement of the tools 30 on the spring-forming table 1 is determined according to the wire diameter and a shape of the spring. An off-centered cam 12 is pointed against the rear end portion of each of the tools 30 radiating on the spring-forming table 1. The cam 12 is rotated by driving force transmitted from a tool-driving motor (not shown) and a gear (not shown) provided on the spring-forming table 1. Each of the tools 30 is slidable toward the wire-feedout hole of the guide mechanism 40 when the off-centered cam is rotated. More specifically, each of the tools 30 moves and stops at predetermined positions, or moves for a predetermined period of time, at a predetermined speed and in a predetermined order, in accordance with the shape and phase difference of the cam 12, so that each of the tools 30 is driven in a slide motion without colliding with one another.

The guide mechanism 40 includes a guide gear 47*a* (FIG. 5) rotatably supported by a guide main body 41 to have the same rotation axis of the wire guide 70. Herein, driving force is transmitted via an output gear 19 and idle gears 17 and 18, which are set at a predetermined gear ratio, to rotate the guide mechanism 40 in a predetermined timing in synchronization with the motion of the above-described each of the tools 30. The output gear 19 is attached via an axle to a guide driving motor 13 provided in the lower portion of the spring-forming table 1.

The wire W is supplied by a wire-feeding roll 11 provided in the rear of the spring-forming table 1 as shown in FIG. 2. The wire W is conveyed, while being pressed from the top and bottom by a pair of feed rollers 14 and 15, through the internal portion of the guide mechanism 40 to the spring-forming table 1. The feed rollers 14 and 15 are provided in the rear of the spring-forming table 1 to clamp the wire W. Moreover, the feed rollers 14 and 15 are rotatably driven by a roller-driving mechanism 16, including a motor, gear and the like, at a predetermined timing to convey the wire W to the spring-forming table 1.

The controller 200 comprises a display unit 204, a keyboard 206 and the like to allow an operator to set the type, size (diameter, length and the like) and the number of units of a spring to be formed.

[Detailed Structure of Rotary-type Wire Guide Mechanism]

Figure 3:
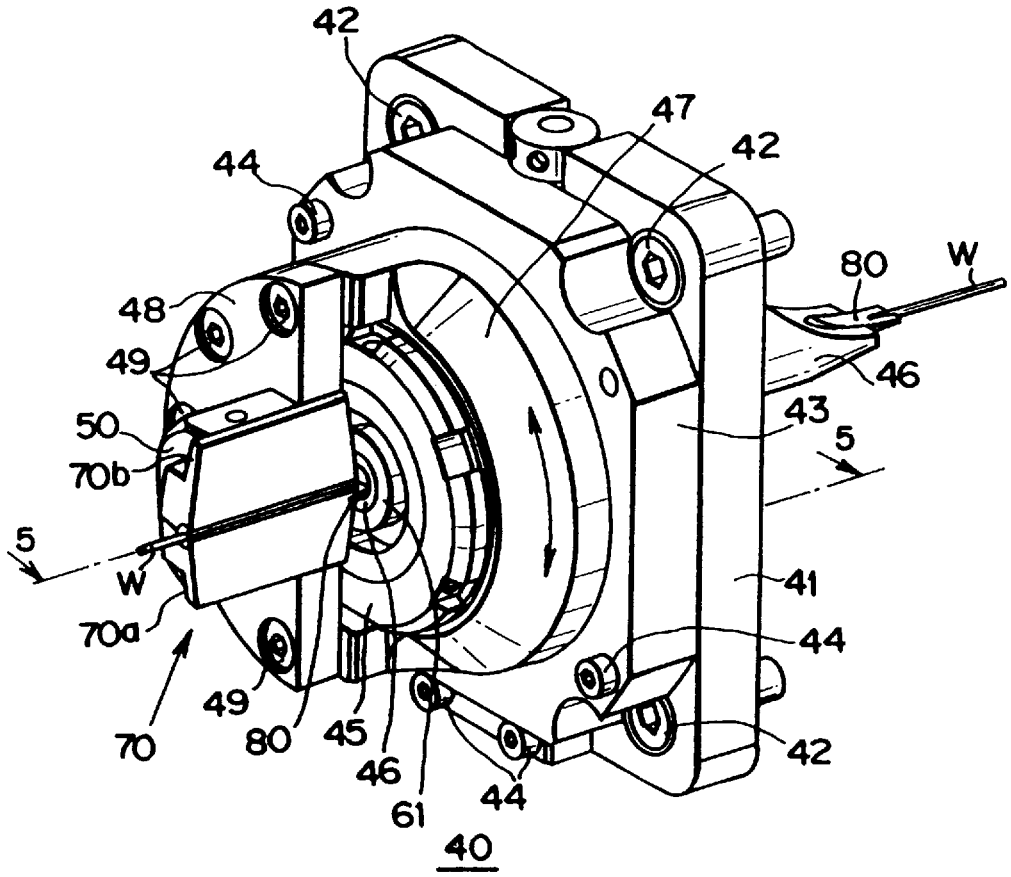
FIG. 3 is a perspective view showing an entire structure of a rotary-type wire guide mechanism according to the present embodiment.
Figure 4:
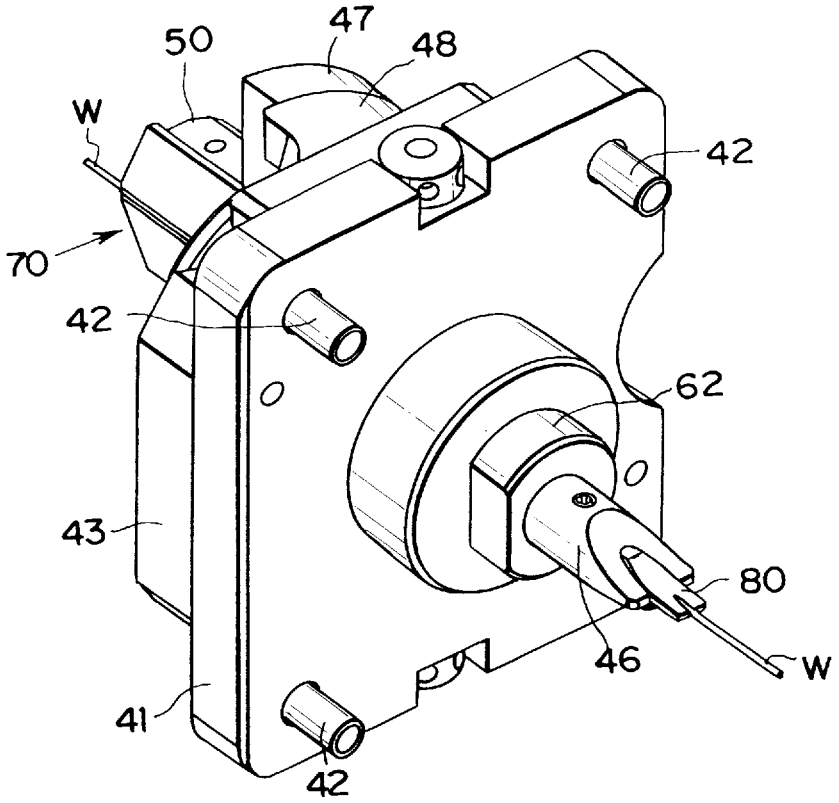
FIG. 4 is a perspective view showing the rear view of the wire guide mechanism shown in FIG. 3.
Figure 5:
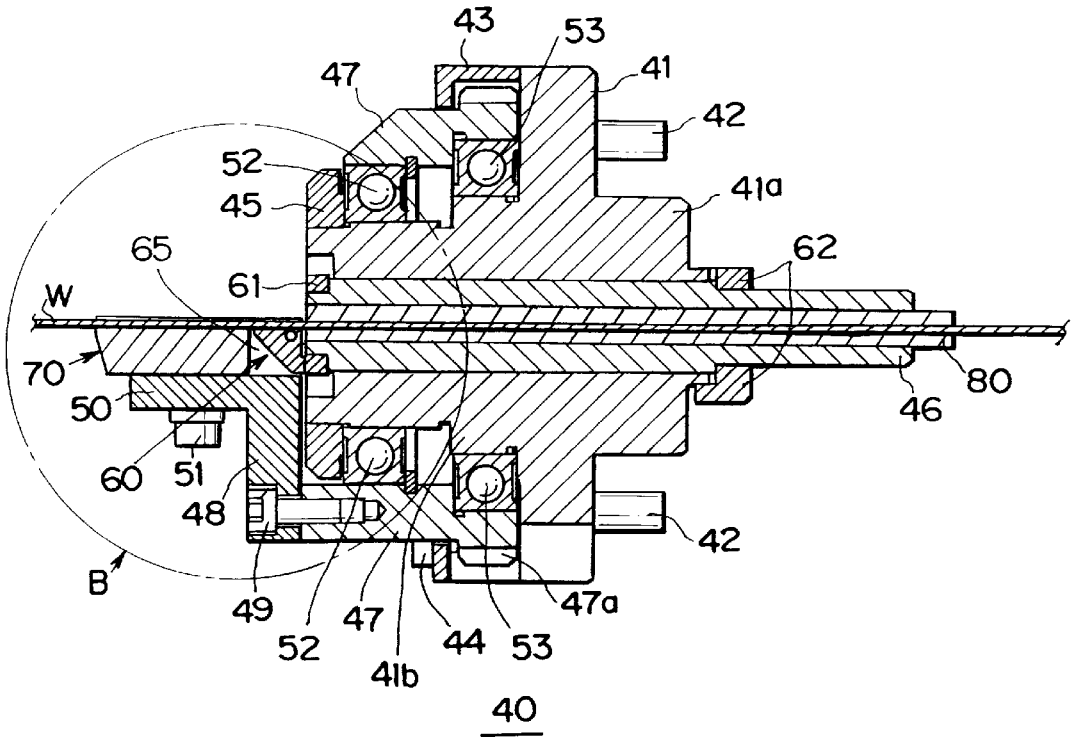
FIG. 5 is a cross-sectional view cut along the A—A line in FIG. 3.

Next, detailed description will be provided on the rotary-type wire guide mechanism 40 which has been described briefly with reference to FIGS. 1 and 2. FIG. 3 is a perspective view showing an entire structure of the rotary-type wire guide mechanism 40 according to the present embodiment. FIG. 4 is a perspective view showing the rear view of the wire guide mechanism 40 shown in FIG. 3; FIG. 5, a cross-sectional view cut along the A—A line in FIG. 3; and FIG. 6, an enlarged view of the portion B shown in FIG. 5.

The guide mechanism 40 comprises a guide main body 41, a cover 43 and a rotation portion 47 as shown in FIGS. 3 to 6. The guide main body 41 is fixed, at four positions, onto the spring-forming table 1 with fixing bolts 42. Furthermore, as shown in FIG. 5, the guide main body 41 has a configuration such that cylindrical projected portions 41*a* and 41*b* are projected from both surfaces of a substantially-square plate material. In the internal portion of the guide main body 41, a through hole is formed to penetrate through a substantial center of the main body. Inside the through hole, a liner insertion member 46 is provided such that it is slidable against the main body 41. In addition, a through hole is formed to penetrate through the substantial center of the liner insertion member 46, and inside this through hole, a liner 80 is provided slidable against the liner insertion member 46 so that the wire W, conveyed from the feed rollers 14 and 15, is fed to the guide 70.

As shown in FIG. 3, the front end portion of the liner insertion member 46 on the side of the projected portion 41*b* is tapered off at the front end to conform with the circumference of the feed rollers 14 and 15. Moreover, at the end portion of the cylindrical projected portion 41*a* (FIG. 5), a bearing stopper 45 is provided. At the front end portion of the liner insertion member 46 on the side of the projected portion 41*a*, a circular grip pressing block 61 (effect thereof to be described later) is provided on the periphery of the front end portion. Furthermore, as shown in FIG. 4, on the periphery of the liner insertion member 46 which is attached to the rear end of the guide main body 41, a liner-insertion-member pressing block 62 (effect thereof to be described later) having a circular shape is provided.

The center of the cover 43 has an opening in conformity with the outline shape of the rotation portion 47 so that the guide gear 47*a* provided in the rotation portion 47 is protected from the outer portion. The cover 43 is fixed to the guide main body 41 with fixing bolts 44.

The rotation portion 47, having a hollow cylindrical shape, has the guide gear 47*a* for rotating the guide 70 on the peripheral rim of the opening on one end of the rotation portion. In the opening portion of the other end of the rotation portion, a semicircular guide-fixing block 48, provided to fix the guide 70, is fixed with fixing bolts 49. The rotation portion 47 is configured such that its internal portion is partially exposed. The rotation portion 47 is engaged, via bearings 52 and 53, with the cylindrical projected portion 41*b* of the guide main body 41, so that the rotation portion 47 is rotatable with respect to the guide main body 41.

The guide-fixing block 48 has a projected portion 50, where cross-section thereof has a concave shape, projected in the wire direction. The wire guide 70 is positioned with a positioning pin 51 and fixed to the concave portion.

The wire guide 70 is made rotatable so that the spring-forming space can be changed by altering the space in the inclined-surface side of the wire guide, thereby enabling to form a spring having a desired shape regardless of the position of the tools 30.

[Wire Grip Mechanism]

Next, the wire grip mechanism will be described.

Figure 6:
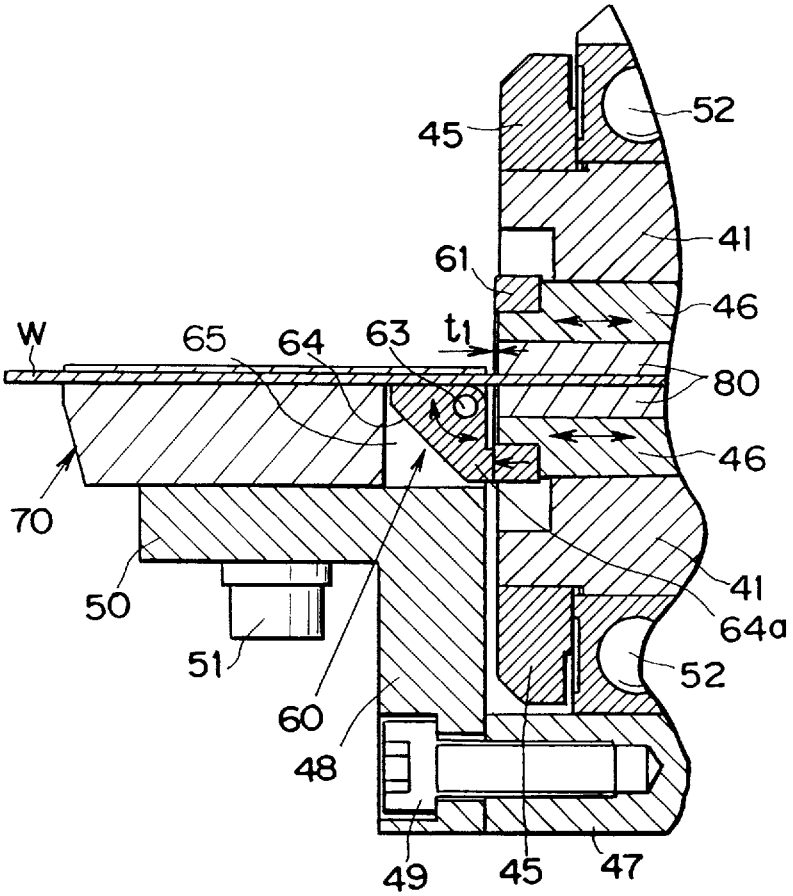
FIG. 6 is an enlarged view of the portion B shown in FIG. 5.

As shown in FIGS. 5 and 6, the guide mechanism 40 comprises a wire grip mechanism 60, which grips the wire W in the wire feedout hole of the wire guide 70 and temporarily twists the wire W by the rotation of the guide mechanism 40. The wire grip mechanism 60 comprises a grip member 64 provided inside the wire guide 70, the circular grip pressing block 61 provided on the periphery of the front end of the projected portion 41*a* of the liner insertion member 46, and the liner-insertion-member pressing block 62, having a circular shape, which is provided on the periphery of the liner insertion member 46 that is adjacent to the rear end of the guide main body 41. The grip member 64 is made of cemented carbide having high wear resistance characteristic, and is rotatable upon a supporting shaft 63 for a predetermined angle in the rear end of the wire guide 70. The grip member 64 is, while being rotatably supported by the supporting shaft 63, located in a housing 65 formed at the rear end of the internal portion of the wire guide 70 (that is, the front end of the liner insertion member 46).

As shown in FIG. 6, the projected portion 64*a* is formed at the rear end of the grip member 64. When the wire W is not gripped (hereinafter, this state will be referred to as the "grip release position"), the projected portion 64*a* is spaced away from the grip pressing block 61 for a space t1 (approximately 0.1 mm). When the liner insertion member 46 is slid towards the guide for the space t1 along the wire feeding direction, the grip pressing block 61 presses the projected portion 64*a* so that the grip member 64 is slightly rotated upon the supporting shaft 63, allowing the grip member 64 to grip the wire (hereinafter, this state will be referred to as the "grip position").

Referring to FIGS. 5 and 6, with respect to the same components already described above, the same reference numerals are assigned and description thereof will be omitted.

As has been described above, on account of the wire guide 70 and the wire grip mechanism 60 provided to the rotatable guide mechanism 40, it is possible to realize twisting operation of the wire by the wire grip mechanism by taking advantage of the rotation of the guide mechanism 40.

Furthermore, by having the grip member 64 in the internal portion of the wire guide 70, it is possible to secure a large distance between the feed rollers 14 and 15 and the wire guide 70, thereby assuring a large torsion amount of the wire.

[Grip Driving Mechanism]

Figure 7:
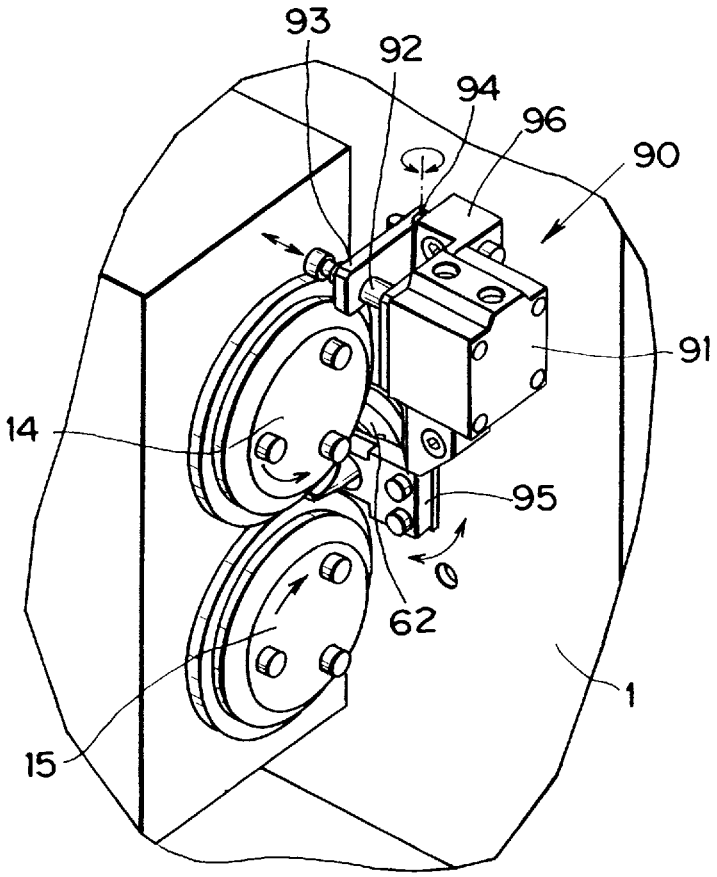
FIG. 7 is a perspective view showing a grip driving mechanism.
Figure 8:
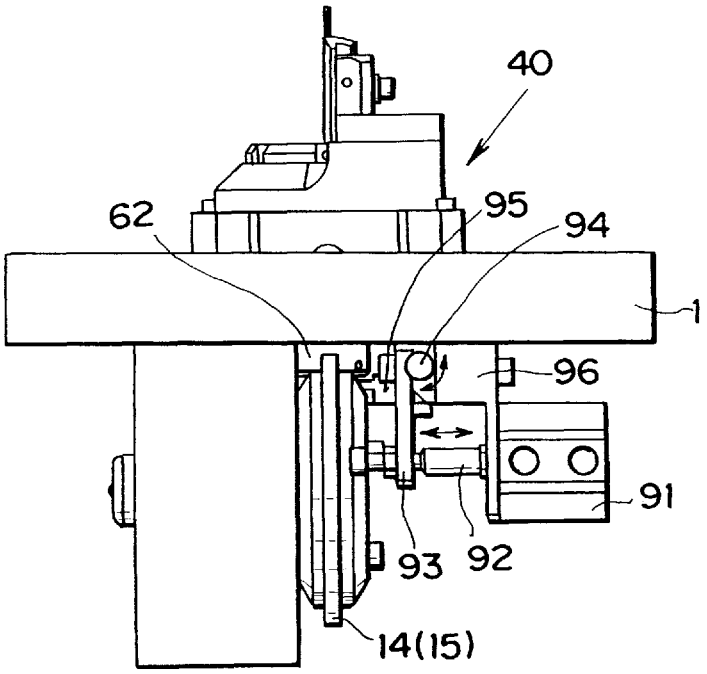
FIG. 8 is a top plan view of FIG. 7.
Figure 9:
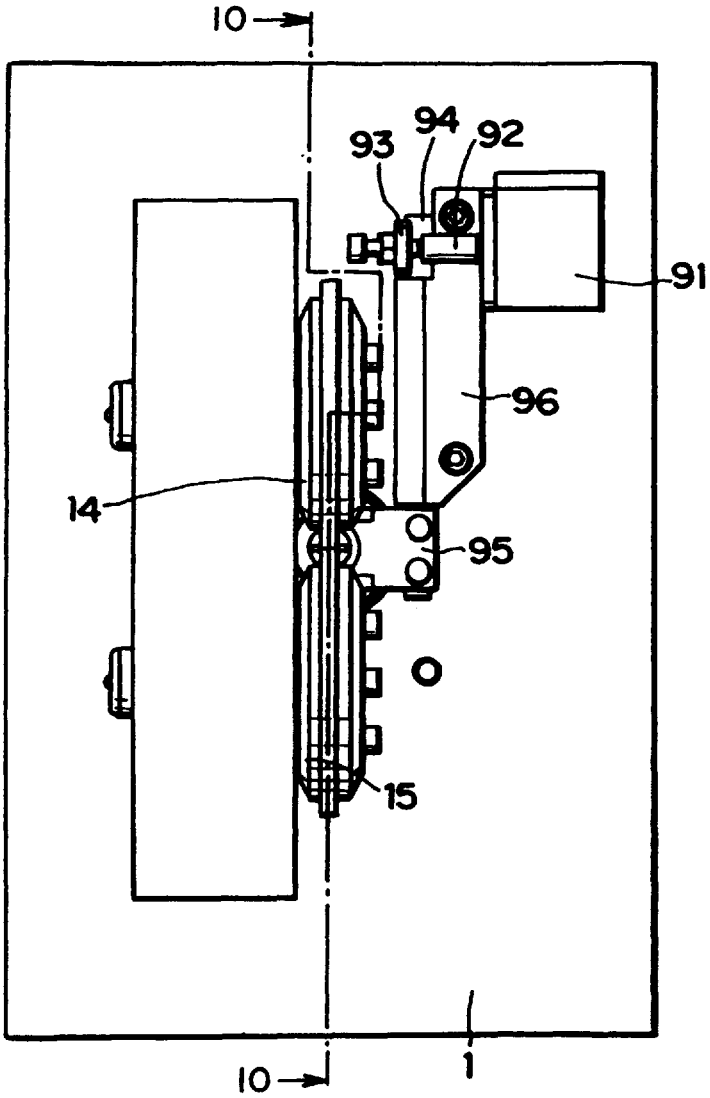
FIG. 9 is a front view of FIG. 7.
Figure 10:
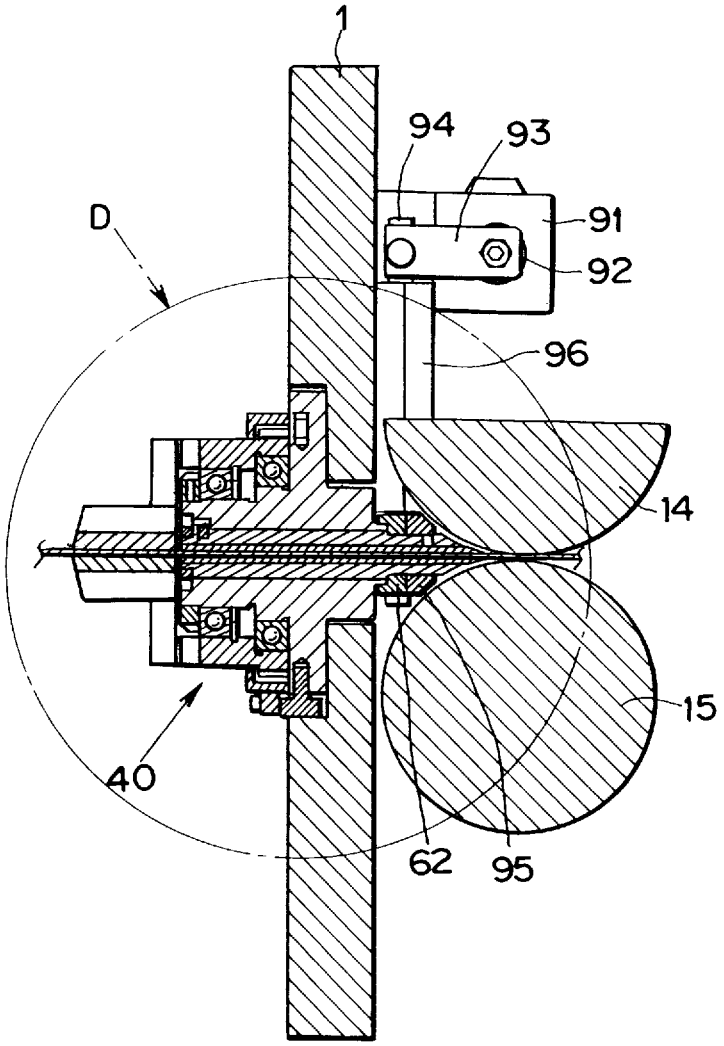
FIG. 10 is a cross-sectional view cut along the C—C line in FIG. 9.
Figure 11:
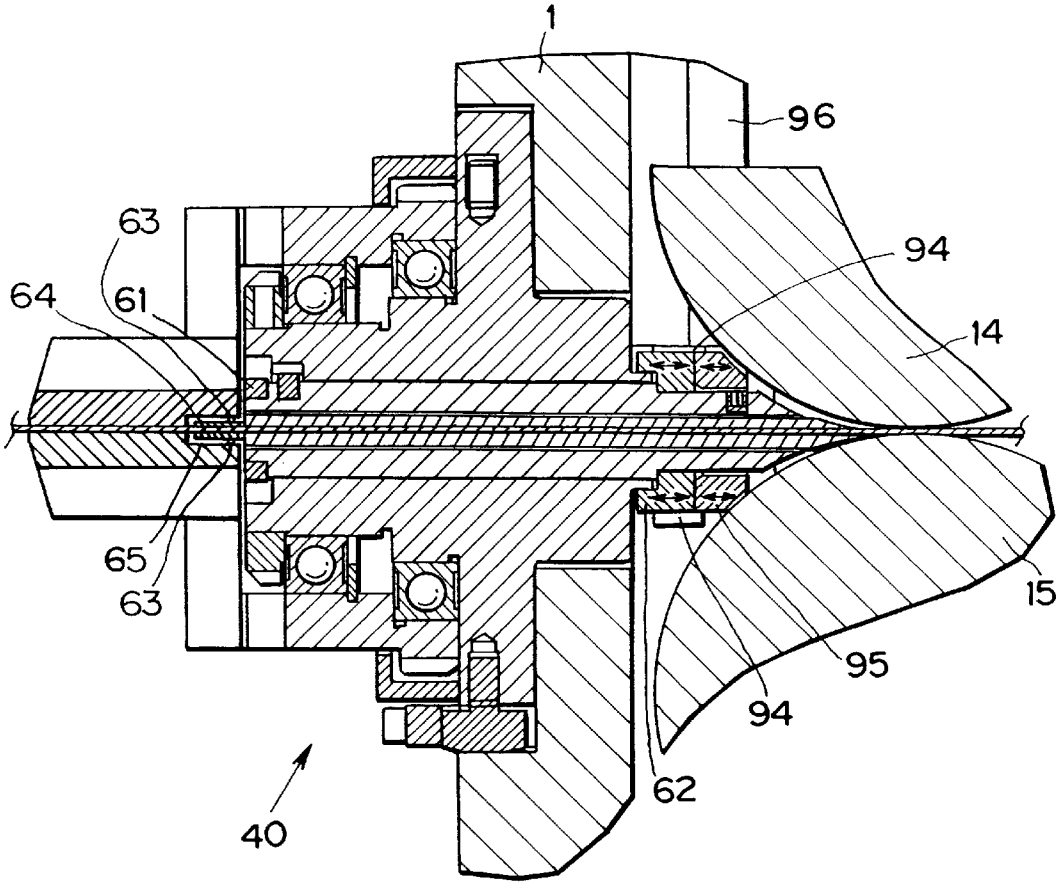
FIG. 11 is a detailed view of the portion D shown in FIG. 10.

Next, description will be provided on a grip driving mechanism which drives the above-described wire grip mechanism to the grip position or to the grip position. FIG. 7 is a perspective view showing the grip driving mechanism; FIG. 8, a top plan view of FIG. 7; FIG. 9, a front view of FIG. 7; FIG. 10, a cross-sectional view cut along the line C—C in FIG. 9; and FIG. 11, a detailed view of the portion D shown in FIG. 10.

As shown in FIGS. 7 to 11, a grip driving mechanism 90, provided in the rear of the spring-forming table, is arranged adjacent to the feed rollers 14 and 15. The grip driving mechanism 90 comprises a grip driving cylinder 91, a slide pin 92, a rotation arm 93, a rotation shaft 94, a block pressing arm 95 and a supporting frame 96. The grip driving cylinder 91, e.g., an air cylinder, is fixed onto the supporting frame 96 which is fixed to the rear of the spring-forming table 1. The slide pin 92 is fixed to an output axle of the grip driving cylinder 91, and one end of the rotation arm 93 is fixed to the slide pin 92. The upper end of the rotation shaft 94 is fixed to the other end of the rotation arm 93, while the lower end of the rotation shaft 94 is fixed onto the block pressing arm 95. The rotation shaft 94 is rotatably supported by an axle of the supporting frame 96. The block pressing arm 95 is provided adjacent to the feed rollers 14 and 15 such that it surrounds a part of the periphery of the liner insertion member 46, and is placed opposite to the liner-insertion-member pressing block 62.

When the grip member 64 is driven to the grip position, the output axle of the grip driving cylinder 91 is slid forward to push one end of the rotation arm 93 via the slide pin 92. Since the other end of the rotation arm 93 is fixed to the upper end of the rotation shaft 94, the rotation shaft 94 is rotated clockwise in FIG. 8, as the rotation arm 93 is pushed. Since the block pressing arm 95 is fixed to the lower end of the rotation shaft 94, the block pressing arm 95 is rotated in correspondence with the rotation of the rotation shaft 94, in the same direction as the rotational direction of the rotation shaft 94, thereby pressing the liner-insertion-member pressing block 62. Since the liner-insertion-member pressing block 62 is fixed to the liner insertion member 46, the liner insertion member 46 is slid forward as the block pressing arm 95 is pressed, and the grip member 64 is rotated to the grip position via the grip pressing block 61.

On the other hand, when the grip member 64 is to be moved to the grip release position, it is not necessary to perform the reverse operation of the above-described operation. To release the grip, the pressure, which has been added to the rotation arm 93 by the output axle of the grip driving cylinder 91, is released. Since the space t1 (e.g. 0.1 mm), provided to allow the liner insertion member 46 to slide, is small, when the pressing force added to the grip member 64 by the liner insertion member 46 is released, the wire W easily returns to its original state because of the resilience of the wire W. As a result, the grip member 64 returns to its normal position due to the restitution force of the wire W.

[Effect of Grip Mechanism]

Next, an effect of the grip mechanism will be described.

Figure 12A:
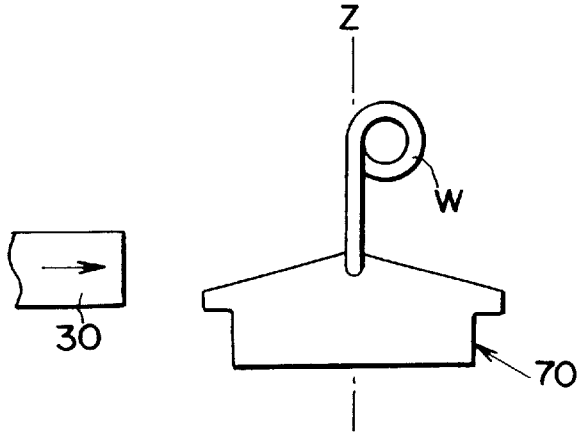
FIG. 12A is a schematic front view of a guide area showing a positional relation among a tool, a wire and a guide in a case where wire direction is not deviated at the time of bending process.
Figure 12B:
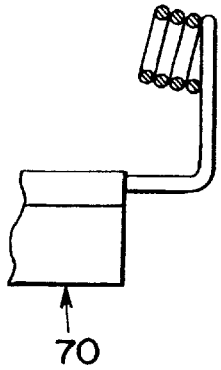
FIG. 12B is a schematic side view of a guide area showing a positional relation among the tool, wire and guide in a case where wire direction is not deviated at the time of bending process.
Figure 13A:
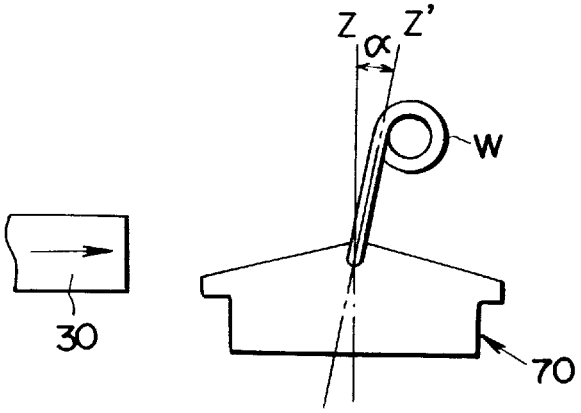
FIG. 13A is an explanatory view showing a positional relation among the tool, wire and guide in a case where wire direction is deviated at the time of bending process.

FIG. 12A is a schematic front view of the guide area showing a positional relation among the tool, wire and guide in a case where wire direction is not deviated at the time of bending process; and FIG. 12B, a schematic side view of a guide area showing a positional relation among the tool, wire and guide in a case where wire direction is not deviated at the time of bending process. FIG. 13A shows a positional relation among the tool, wire and guide in a case where wire direction is deviated at the time of bending process; and FIG. 13B, a positional relation among the tool, wire and guide in a case where the deviation of wire direction is corrected.

Figure 13B:
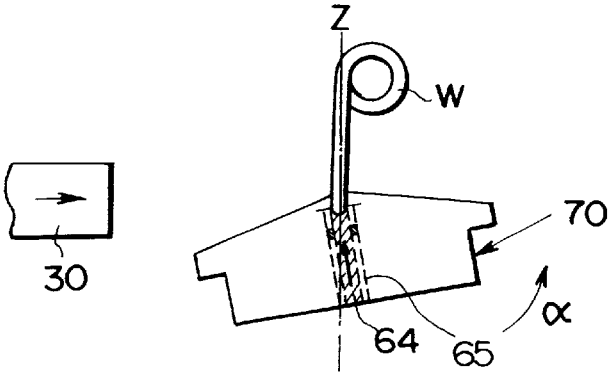
FIG. 13B is an explanatory view showing a positional relation among the tool, wire and guide in a case where the deviation of wire direction is corrected.

As shown in FIGS. 12A and 12B, the bending tool 30 is slid orthogonally to an axis line Z, which is the longitudinal direction of the wire W, to bend the wire W. This condition is assumed to be the state where the wire direction is not deviated. In the condition shown in FIG. 13A, the axis line Z', which is the longitudinal direction of the wire W, is deviated for an angle $\alpha$ from the non-deviated axis line Z. In order to correct the deviation of the wire direction, the grip mechanism grips the wire W in the condition shown in FIG. 13A, then rotates the wire guide 70 leftward for the deviation angle a to temporarily twist the wire W as shown in FIG. 13B. As a result, the deviated axis line Z' of the wire W is corrected to the non-deviated axis line Z. If the bending tool 30 bends the wire W in the condition shown in FIG. 13B, bending operation is realized in the same condition as that shown in FIGS. 12A and 12B without changing the position of the tool 30. A twisting angle of the grip mechanism, that is, the range of angles where the deviation of the wire direction can be corrected, is preferably $-30° \leqq \alpha \leqq 30°$ within the range of elastic deformation of the wire, when measured in the clockwise direction from the axis line Z. It should be noted that the range depends upon a wire diameter and characteristics of the machine.

As described above, the wire grip mechanism 60 can be applied to correct the deviation of the wire direction. In addition, the wire grip mechanism 60 is also applicable to a case where wire is bent with a slight angle.

Note that when the grip mechanism 60 grips the wire W, rotation of the feed rollers 14 and 15 is stopped so that the wire W is not fed.

Even if the guide mechanism 40 is rotated while the wire is gripped, the feed rollers 14 and 15 and the grip mechanism 60 grip the wire W with such pressure that the wire does not slide or rotate in the direction of an axis along the liner 80.

As described above, since the grip mechanism for gripping the wire W is arranged rotatable in accordance with the wire guide 70 provided for feeding the wire W, it is no longer necessary to comprise the conventional rotation mechanism, e.g. correction tools, a chuck nail and the like.

In addition, by having the grip member inside the wire guide 70, it is possible to secure a large distance between the feed rollers 14 and 15 and the wire guide 70, and assure a large torsion amount. Furthermore, since the additional rotation mechanism and the like is not necessary, it is possible to improve flexibility in terms of layout and further possible to reduce cost by down-sizing the apparatus.

Moreover, by setting, in advance, a deviation of wire direction generated in the similar forming operation or a predetermined bending angle, it is possible to automatically adjust the direction of the wire W, fed by the wire guide 70, at each forming process in accordance with the position of the tool 30. Accordingly, precision in spring forming is improved, and working time is reduced.

[Control Block]

Next, description will be provided on a control block of the spring manufacturing machine 10 according to the present embodiment.

Figure 14:
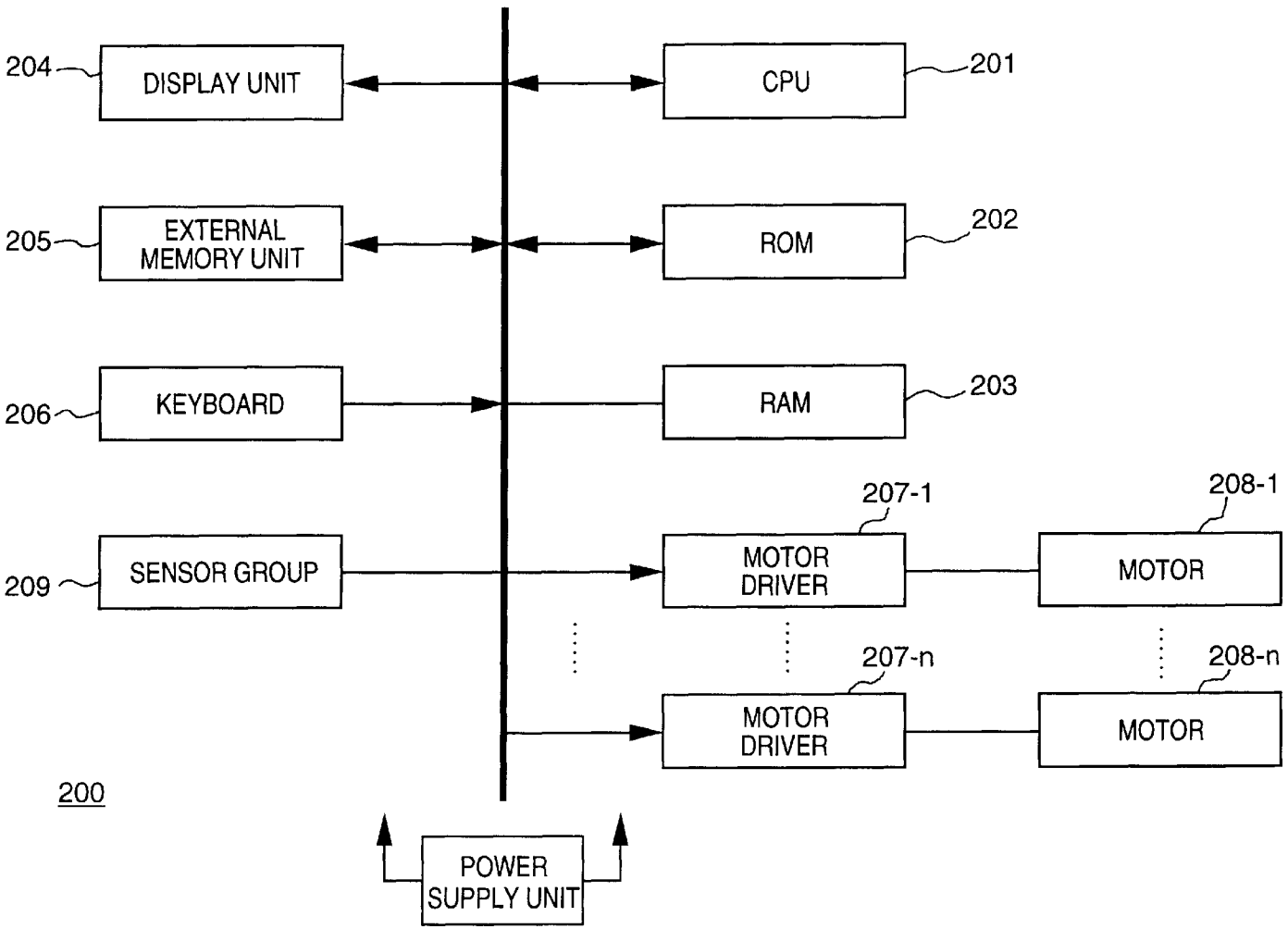
FIG. 14 is a block diagram showing a controller of the spring manufacturing machine.

FIG. 14 is a block diagram showing the controller 200 of the spring manufacturing machine.

As shown in FIG. 14, a CPU 201 controls the entire controller 200. A ROM 202 stores contents (programs) of operation process of the CPU 201 and various font data. A RAM 203 is used as a work area of the CPU 201. Display unit 204 is provided for various setting, or for displaying a manufacturing procedure or the like in a graph. An external memory unit 205, such as a floppy disc drive or the like, is used to supply programs from an external unit, or to store various setting contents for spring forming. If parameters for a certain forming process (e.g., in a case of forming a spring, the free height or diameter of the spring) are stored in a floppy disc or the like, it is possible to manufacture a spring having the same shape at any time by setting the floppy disc.

The keyboard 206 is provided to set various parameters. A sensor group 209 is provided to detect the wire-feed amount and free height of the spring.

Each of the motors 208-1 to 208-n indicates the above-described roller driving motor (not shown), guide driving motor 13, grip cylinder 91 and tool-driving motor (not shown). Each of the motors 208-1 to 208-n is driven by respective motor drivers 207-1 to 207-n.

In the foregoing control block, the CPU 201 performs controlling, for instance, for independently driving various tool motors, controls input/output operation with external memory units, and controls the display unit 204, in accordance with an instruction inputted from the keyboard 206.

[Shape of Wire Guide]

Figure 15:
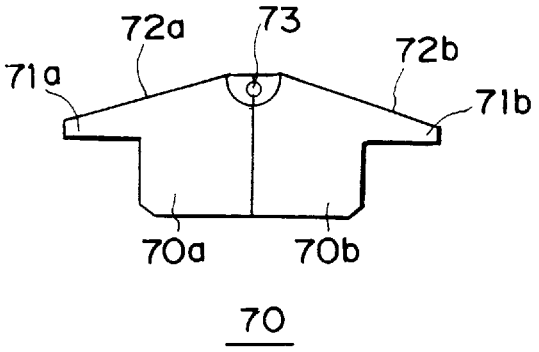
FIG. 15 is a front view of the wire guide.

Next, characteristics of the shape of the wire guide will be described. FIG. 15 is a front view of the wire guide.

As shown in FIG. 15, the wire guide 70 is constructed by a left guide piece 70*a* and a right guide piece 70*b* which is symmetrical to the left guide piece 70*a*. The grip member 64 is supported by one of the housing of the left guide piece 70*a* or the right guide piece 70*b* via the supporting shaft 63. The upper surfaces of the left guide piece 70*a* and the right guide piece 70*b* respectively form inclined surfaces 72*a* and 72 *b* having a predetermined inclination angle. The left guide piece joins the right guide piece to form a wire feedout hole 73 whose cross section is round. The inclined portion 72*a* and 72*b* are extended outward with a predetermined downward inclination angle θ, which is set approximately at 10°. In other words, by rotating the above-described guide mechanism 40, the inclined surfaces 72*a* and 72*b* of the wire guide 70 change the spring-forming space, which is prescribed by the inclined surfaces 72*a* and 72*b*.

By constructing the guide 70 with the left guide piece 70*a* and the right guide piece 70*b* both having the symmetrical shape, it is possible to incorporate the grip member 64 in the internal portion of the wire guide 70, and possible to easily exchange a damaged piece of the grip member 64.

Figure 16:
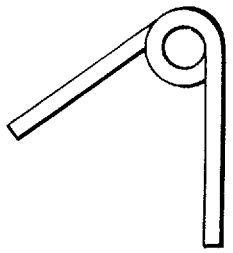
FIG. 16 shows the shape of a spring having a long leg.

Furthermore, the wire guide 70 includes wing portions 71*a* and 71*b* which are extended from each of the inclined surface 72*a* and 72*b*. By having the extended wing portions 71*a* and 71*b*, a large area of the inclined surfaces 72*a* and 72*b* is assured, and moreover the sides of the inclined surfaces 72*a* and 72*b* are lowered. Therefore, when a spring having a long leg as shown in FIG. 16 is to be formed, the end portion of the leg can be smoothly guided to the inclined surfaces 72*a* and 72*b* at the time of bending the leg.

Note that the present invention is applicable to a modified example of the above-described embodiment within the scope not exceeding the spirit of the invention.

For instance, instead of including the grip member 64 in the internal portion of the wire guide 70, the grip member 64 may be incorporated in other portion (e.g. guide-fixing block 48 near the end of the wire guide 70) of the guide mechanism 40 together with the grip driving mechanism 90.

[Effect]

As has been set forth above, by virtue of the wire grip mechanism for gripping a wire, which is rotatable in accordance with the wire guide provided for feeding the wire, the conventional rotation mechanism such as correction tools and chuck nail is no longer necessary. Therefore, it is possible to secure a large torsion amount, improve flexibility in terms of layout, and down-size the apparatus, thereby reducing the cost.

Furthermore, by rotating the wire mechanism while the feed rollers and wire grip mechanism grip a wire, the wire, positioned between the feed rollers and the wire grip mechanism, is temporarily twisted so that the direction of the wire fed from the wire feedout hole is changed. If a deviation of wire direction generated in the similar forming operation is set in advance, it is possible to adjust the direction of the wire, fed by the wire guide, at each forming process in accordance with the position of the tool. Accordingly, precision in spring forming is improved, and working time is reduced.

The present invention is not limited to the above embodiments and various changes and modifications can be made within the spirit and scope of the present invention. Therefore, to appraise the public of the scope of the present invention, the following claims are made.

What is claimed is:

1. A spring manufacturing apparatus for forming a spring from a wire fed from an end of a wire guide, and forcibly bending or coiling the wire with the use of tools which are pointed against the wire for bending and coiling the wire, and are arranged slidably in a radial pattern toward a spring-forming space near the end of the wire guide said wire guide having an internal portion with internal walls, said wire guide having a wire feedout hole within internal walls for feeding the wire to the spring-forming space, the apparatus comprising:

rotating means, rotatably provided in a central area of a main body of the apparatus where sliding locus of the tools intersects, for rotating the wire guide around the wire feedout hole while supporting the wire guide;

first driving means for transmitting rotation force to said rotating means;

wire-feeding means, provided in an upstream side of a wire-feeding path along a wire direction of said rotating means, for feeding the wire to the spring-forming space through the wire feedout hole by rotating the wire while gripping the wire;

second driving means for driving said wire-feeding means;

wire-gripping means, provided in said internal portion of said wire guide, for gripping the wire between the internal walls of said wire feedout hole;

third driving means for driving said wire-griping means to grip the wire; and controlling means for controlling said first, second and third driving means at a predetermined timing, and rotating said rotating means while said wire-feeding means and said wire-gripping means grip the wire, so that the wire positioned between said wire-feeding means and wire-gripping means is temporarily twisted and a direction of the wire fed from the wire feedout hole is changed.

2. The spring manufacturing apparatus according to claim 1, wherein said wire-gripping means is arranged in the internal portion of the wire guide, and is provided near a rear end of the wire feedout hole.

3. The spring manufacturing apparatus according to claim 1, wherein said controlling means prohibits said wire-feeding means to feed the wire when said wire-gripping means is gripping the wire.

4. The spring manufacturing apparatus according to claim 1, wherein even if said rotating means is rotated while the wire is gripped, said wire-feeding means and said wire-gripping means grip the wire with such pressure that the wire does not slide or twist in the wire feedout hole.

5. The spring manufacturing apparatus according to claim 1, wherein the wire is twisted within a range of elastic deformation of the wire.

6. The spring manufacturing apparatus according to claim 1, wherein said controlling means changes the direction of the wire in accordance with a relative positional relation between the tools, provided according to a desired shape of the spring, and the wire.

7. The spring manufacturing apparatus according to claim 1, wherein the wire guide includes a first guide block half and a second guide block half which are separable, and said wire-gripping means is supported by one of these guide block halves.

8. The spring manufacturing apparatus according to claim 7, wherein the first and second guide block halves are symmetric with each other, and each half has a predetermined inclined surface.

* * * * *